United States Patent [19]

Kankaanpaa

[11] 4,089,738

[45] May 16, 1978

[54] METHOD AND APPARATUS FOR INFLUENCING THE CHARACTERISTICS OF THE SURFACE OF A PAPER PRODUCT

[75] Inventor: Matti Kankaanpaa, Espoo, Finland

[73] Assignee: Valmet Oy, Finland

[21] Appl. No.: 579,061

[22] Filed: May 20, 1975

[30] Foreign Application Priority Data

May 23, 1974 Finland ..... 1587/74

[51] Int. Cl.[2] ..... B24B 39/00; D21F 3/08; D21F 50/00; D21G 1/02

[52] U.S. Cl. ..... 162/206; 29/90.1; 29/90.3; 34/12; 34/152; 100/93 RP; 100/161; 162/205; 162/288; 162/290; 162/305

[58] Field of Search ..... 162/205, 206, 204, 288, 162/290, 305, 358, 359, 360 R, 361; 29/90.1, 90.3; 100/93 RP, 156, 161; 34/12, 116, 152

[56] References Cited

U.S. PATENT DOCUMENTS

| | | | |
|---|---|---|---|
| 125,548 | 4/1872 | De Forest | 29/90.3 |
| 735,824 | 8/1903 | Rogers | 29/90.3 |
| 1,679,711 | 8/1928 | Dawe | 29/90.1 |
| 3,124,504 | 3/1964 | Mahoney et al. | 162/206 |
| 3,131,571 | 5/1964 | Hornbostel | 162/358 X |
| 3,206,869 | 9/1965 | Justus | 162/359 X |
| 3,215,592 | 11/1965 | Justus et al. | 162/358 X |
| 3,667,380 | 6/1972 | Schlunke et al. | 100/161 |

*Primary Examiner*—Richard V. Fisher
*Attorney, Agent, or Firm*—Steinberg & Blake

[57] ABSTRACT

During the manufacture of a paper product such as paper or cardboard, a moving web of sheet material which is to form the paper product is lapped over a roll while the relatively smooth, hard surface of a smoothing member is pressed against an outer surface region of the sheet material across the entire width thereof while an inner surface region thereof engages the roll, so as to impart in this way desired characteristics to the surface of the web engaged by the smoothing member, with a frictional rubbing action being provided between the web and the surface of the smoothing member. The above roll may be the roll of a press section, a drying section, or a calendering section of a paper machine, and a suitable support structure carries the smoothing member to maintain the latter in engagement with the moving web. The smoothing member may be fixed to the supporting structure or may take the form of a smoothing roller supported for rotary movement by the supporting structure.

18 Claims, 6 Drawing Figures

METHOD AND APPARATUS FOR INFLUENCING THE CHARACTERISTICS OF THE SURFACE OF A PAPER PRODUCT

BACKGROUND OF THE INVENTION

The present invention relates to a method and apparatus used during manufacture of a paper product such as paper or cardboard in order to influence the surface characteristics of the paper product.

Thus, the present invention relates to a method and apparatus to be used in connection with a paper machine for the purposes of improving the surface smoothness and gloss of paper or cardboard, the apparatus including one or more smoothing means which operate in such a way as to have a rubbing action with respect to the surface of the web which is to be smoothed.

It is of course well known that the surface smoothness and gloss of a paper product may be influenced in a paper machine by the calender treatment subsequent to the drying of the web. If such calender treatment is not provided the surface of the web will remain uneven and rough to a greater or lesser extent. This unevenness results from the manner in which the paper product is manufactured. During formation of the web at the wet end of the paper machine the forming web is contacted at one or both sides by wire and felt fabrics. These fabrics produce in the web surface a so-called marking or pattern which is determined by the structure of the wire and felt belts or fabrics. Furthermore, the unevenness and roughness of the paper will also result from shrinkage and crumpling of the web during the drying phase.

The calender treatment may be carried out with a calender assembly which forms part of the machine itself, this calender assembly being situated in the paper machine between the drying cylinder section and the reeling section. Also it is possible to provide calender treatment with a separate supercalender assembly which forms part of a structure for treating the paper subsequent to the manufacture thereof. The smoothing and burnishing action achieved both by a calender forming part of the machine or by a supercalender results from compression and deformation acting on the paper web at nips formed between rolls of such calender assemblies. However, there is no differential between the surface speed of the calender rolls and the travelling speed of the web in the nips therebetween. In other words there is no slippage between the web and the rolls. This action achieved from the machine calender as well as from a supercalender results not only in an increased smoothness and gloss of the paper product but also in a considerable reduction in the thickness of the paper and in an equalization of thickness variations, precisely as a consequence of the pressure exerted on the web in the nips between the rolls of the calenders.

With respect to the present state of the art, there is a known friction-type of calender which at one time was widely used for burnishing cardboard on one side thereof as well as for providing certain special papers of so-called high gloss. Such a friction calender includes two rolls, one of which is an elastic paper or filled roll while the other is a glossy chilled-iron roll having a smooth hard surface. The latter roll is rotated at a peripheral velocity which is 2–4 times the rotary speed of the paper roll. The paper web or cardboard web travels through the nip defined between such rolls, and at this nip the chilled roll which has a surface speed higher than the travelling speed of the web produces a burnishing action on the surface of the web which engages this chilled roll. In the event that it is desired to burnish such a web on both sides it must be directed at least twice through a pair of calender rolls. It is, however, also possible to utilize two calenders, one after the other, with one of the calenders providing burnishing at the top side of the web while the other of the calenders provide burnishing at the underside of the web.

With respect to the state of the art, reference may also be made to German Pat. Nos. 527,130 and 597,449.

Calender treatment is particularly necessary in the case of paper to be used for writing or printing. Where paper is to serve as writing paper of where it is to serve primarily for text which is to be printed, a machine calender treatment may suffice. However, if the paper is to be used for printing in connection with accurate reproduction of illustrations or for multicolor printing, then the paper is required to possess a high degree of surface smoothness and in many cases also a gloss in addition to the high surface smoothness. In such cases a paper smoothing and burnishing treatment by way of a separate supercalender is required.

SUMMARY OF THE INVENTION

It is accordingly a primary object of the present invention to provide a method and apparatus which are relatively simple and which at the same time can readily be incorporated into and combined with the normal operation and construction of a paper machine for the purpose of bringing about a paper product which will have at its surface a higher gloss and smoothness that can be achieved with a conventional machine calender.

Thus, it is an object of the present invention to provide a method and apparatus which will render the use of a supercalender unnecessary.

It is in particular an object of the present invention to provide a method and apparatus according to which it is possible to influence the surface of the paper during the manufacture thereof and in particular prior to drying so that the surface of the web of sheet material can be improved before the drying action causes the drying-in or setting of the marking caused by the texture of the wire and felt structures which necessarily engage the web surface. Elimination of such marking by way of a calender treatment is extremely difficult to achieve.

It is also an object of the present invention, in connection with a cardboard product, to achieve an improvement in the gloss of the cardboard while at the same time preserving to a considerable degree the stiffness of the cardboard as it travels through the machine.

Thus, it is an object of the present invention to provide a method and apparatus according to which it becomes possible to act on the paper web as it travels from the press section of the paper machine, so that the desired influence on the surface will be produced prior to the time when the web is subjected to a drying action.

However, it is also an object of the present invention to provide a method and apparatus according to which it becomes possible to improve the surface characteristics of the web during travel thereof through the drying section as well as during travel thereof through a calender of the machine.

It is yet another object of the present invention to provide a method and apparatus according to which it becomes possible to achieve the desired results by way of relatively small components so that in connection with cardboard, for example, there is no requirement of lapping the cardboard web around rolls of relatively small diameter. This latter type of operation on cardboard has in the past resulted in undesirable loss of part of the stiffness of the cardboard.

A still further object of the present invention is to provide a method and apparatus according to which the components which act on the web to improve the surface characteristics thereof are only required to move, if they are not stationary, at speeds which are considerably less than the speed of travel of the web itself, so that the necessity of providing structures to achieve movement of components at speeds equal to or greater than the speed of the travelling web is avoided.

According to the invention a moving web of sheet material which is to form a paper product such as paper or cardboard is lapped over a roll of a paper machine while the smooth, hard surface of a smoothing member is pressed against an outer surface of the web at a region where its inner surface engages the above roll. This surface of the smoothing member is pressed against the web with a predetermined pressure and at the same time provides a rubbing action with respect to the web so as to achieve desired surface characteristics in the web. The above roll can be a roll of any one of a number of different sections of the paper machine such as the press section, the drying section, or the calendering section thereof, and the smoothing member is carried by a suitable support means which serves to maintain the smoothing member in engagement with the travelling web at the outer surface thereof.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
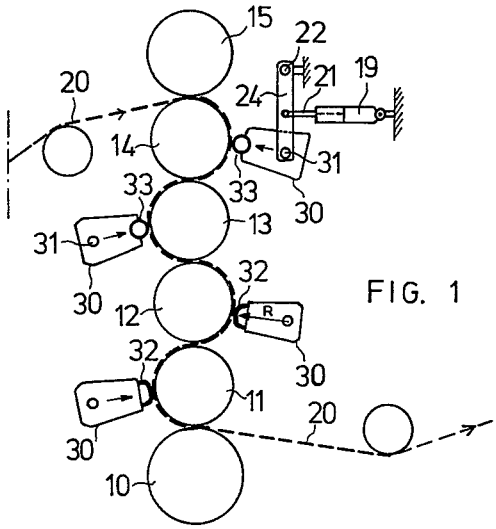
FIG. 1 is a schematic illustration of a conventional calender stack forming part of a paper-manufacturing machine, this conventional calender assembly of the paper machine being provided with additional components according to the invention for carrying out the method of the invention.

Referring to FIG. 1, there is schematically and fragmentarily illustrated therein a calender stack forming part of a known machine calender which forms part of the paper-manufacturing machine. The particular calender illustrated is a multiple-roll vertical calender the unillustrated frame of which may be either of the open or closed type. The calender stack includes the calender rolls 10, 11, 12, 13, 14, and 15, as seen from the bottom toward the top. All of these rolls 10–15 have extremely hard, wear-resistant surfaces. The rolls 10 and 15 which form the king and queen, or bottom and top rolls, respectively, of the calender stack may be of the type which are compensated with respect to their deflection. In certain special cases the intermediate rolls 11–14 may also be deflection-compensated.

The web 20 which is to be smoothed by treatment in the calender passes through the calender in a serpentine manner, as shown in FIG. 1. Thus the web 20 enters first into the nip between the calender rolls 14 and 15, and then passes in opposite directions around the succeeding lower rolls until the web discharges from between the rolls 10 and 11 toward the right, as indicated at the lower part of FIG. 1.

The assembly of FIG. 1 includes, in accordance with the present invention, four smoothing means which respectively cooperate with the intermediate calender rolls 11–14. In accordance with the invention the smoothing means may take the form of rotary smoothing rollers 33, shown extending along and situated next to the calender rolls 13 and 14 on non-rotary smoothing members 32 shown extending along and located next to the calender rolls 11 and 12. Each smoothing means is carried by a support means 30. Thus, the support means 30 supports the smoothing rollers 33 for rotary movement, while the smoothing members 32 are fixed to the pair of lower support means 30 shown in FIG. 1. Each support means 30 is in the form of an elongated hollow beam forming, for example, a box-type beam. Each hollow supporting beam 30 has opposed end walls respectively carrying pins 31 which are coaxial so that the common axis of the pins 31 forms a turning or tilting axis for the support means 30 and the smoothing means 32 or 33 carried thereby. The support means includes in addition to the beam 30 a structure which is connected to the beam 30 for applying through the latter a pressure in which the smoothing means is urged against the surface of the moving web of sheet material 20. The pressure is applied to each beam 30 by way of the end pins 31 thereof, and preferably the pressure force with which the plurality of smoothing means are urged against the outer surface regions of the web is adjustable. As will be apparent from the description below, the plurality of smoothing means engage the outer surface regions of the web at a particular calender roll so as to smooth the surface of the web.

Each beam 30 and the smoothing means 32 or 33 carried thereby may have a length equal to the length of each of the calender rolls 11–14, this length in any event being great enough so that it is possible for each smoothing means to extend across and somewhat beyond the entire width of the travelling web 20. The longitudinal axis of each smoothing means and of the beam 30, which is to say the common axis of the pins 31 connected to the beam 30, extend parallel to the axes of the several calender rolls. Each smoothing means 32, 33 is made of a hard material and has a smooth exterior surface for engaging the web. Thus, the smoothing means 32 or 33 may be made of a hard metal or of a suitable ceramic substance such as silicium carbide, aluminum oxide, or the like, such material being commercially and freely available and having among other desirable characteristic features a microporous surface by virtue of which a desirable smoothing and burnishing action is achieved. For different paper brands or types, the metals or ceramics used for the smoothing means 32 or 33 may be selected so as to have different porosities. It will be noted that in the case of FIG. 1, the inner surface region of the web 20 which engages the roll 14 forms the outer surface region of the web 20 engaging the roll 13, and so on, so that with this particular arrangement the plurality of smoothing means of the invention act alternately on the opposed faces or sides of the web.

As has been indicated above, the support means for each smoothing means includes not only the beam 30 but also the structure for urging the beam 30 together with the smoothing member carried thereby toward the outer surface region of the moving web. The structure for achieving this pressure is shown schematically in connection with the smoothing means 33 of FIG. 1 which cooperates with the calender roll 14, but it is to be understood that the same structure is operatively connected with the remaining beams 30 shown in FIG. 1. Thus, the pair of pins 31 of each beam 30 are respectively received in suitable openings situated at the lower ends of a pair of levers 24. The upper ends of the levers 24 are respectively formed with openings through which a rod 22 passes, this rod 22 being stationary and fixedly carried by the frame structure of the machine in any suitable way. Thus, the pair of arms 24 are free to turn around the rod 22. A further rod extends between and is fixed to the pair of lever members or arms 24, and this latter rod is fixed intermediate its ends to a piston 21 which extends into a power cylinder 19 in the form of a suitable hydraulic unit. If desired a pair of power cylinders 19 and pistons 21 can be provided for the pair of arms 24. A fluid such as a suitable liquid or air is situated in each power cylinder 19, and the pressure of this fluid is adjusted so as to urge the levers 24 in a clockwise direction around the rod 22, as viewed in FIG. 1 at the upper part thereof, and in this way the desired pressure of the smoothing means with respect to the travelling web is achieved. Once the support means has a suitably adjusted position as shown at the upper right of FIG. 1, for example, suitable set screws which pass through lower portions of the arms 24 may be pressed into engagement with the pins 31 for maintaining a desired angle between the beam 30 and the arms 24.

Where the smoothing means takes the form of rollers 33, these rollers may each have at their ends pins extending along the axis of each roller and received in suitable bearings carried by the end walls of the beam 30. Where the smoothing means takes the form of members 32, described in greater detail below, these members are simply fixed directly to the beams 30.

The smoothing action is achieved with the method and apparatus of the invention as a result of the fact that the smoothing member 32 or 33 is urged against the moving web while a frictional rubbing is achieved between the smoothing member 32 or 33 and the moving web. In the case of members 32, these members may simply remain stationary with respect to the moving web, while in the case of rollers 33, the latter may be rotated at speeds substantially less than the speed of movement of the web either by way of a suitable drive means or by rotating the rollers 33 in response to frictional engagement with the moving web while at the same time applying a braking force at the roller 33 to retard the rotation thereof by the travelling web.

Figure 2A:
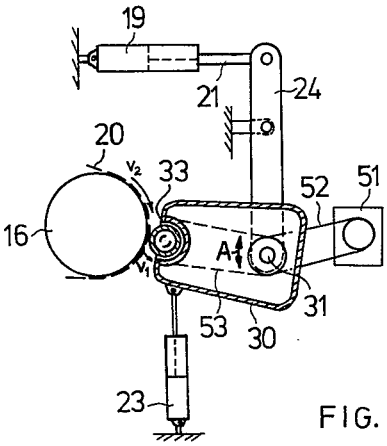
FIG. 2A illustrates in greater detail an embodiment where the smoothing member is in the form of a rotating smoothing roller with FIG. 2A showing also in a schematic manner how it is possible to drive as well as reciprocate the smoothing roller.

In the case of FIG. 2A, the smoothing member takes the form of a rotary roller 33 made of a hard metal or ceramic material and preferably having a relatively small diameter as compared to the diameter of the roll around which the web 20 is lapped in order to come into engagement with the smoothing roller 33. In the example shown in FIG. 2A, the roller 33 rotates in a counterclockwise direction, as viewed in FIG. 2A, at a speed $v_1$, as indicated in FIG. 2A. This latter angular speed is considerably less than the angular velocity of the web 20 around the axis of the roll 16 which corresponds to one of the calender rolls 11–14 of FIG. 1. Thus, it will be seen from FIG. 2A that the angular velocity of the web 20 is indicated at $v_2$, and this angular velocity is much greater than the angular velocity $v_1$ of the roller 33.

Figure 2B:
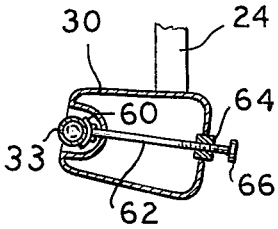
FIG. 2B shows fragmentarily and partly in section a variation of the structure of FIG. 2A according to which with the arrangement of FIG. 2B it is possible to brake the rotary movement of the smoothing roller.

As was indicated above, it is possible to control the rotary speed of the roller 33 by rotating the latter in response to frictional engagement with the moving web while at the same time braking the rotation of the roller 33. Such an arrangement is illustrated schematically in FIG. 2B. Thus, the roller 33 shown in FIG. 3B is supported for free rotary movement by way of suitable bearings carried by the end walls of the beam 30 which is supported from arms 24 in the manner described above. However, in engagement with the roller 33 is a brake member 60 which carries at its rear a sleeve receiving the end of an adjustable rod 62. The rod 62 is threaded through a nut 64 which is fixed to the beam 30 in the manner shown in FIG. 2B, and the rod 62 has at its exterior end a handle 66 by means of which the rod 62 can be turned to adjust the pressure of the brake means 60 with respect to the roll 33. Thus with this construction it is possible to retard the rotation of the roller 33 by the moving web 20 so as to provide for the roller 33 a substantially lesser surface velocity than the linear speed of the web 20.

However, as is shown in FIG. 2A it is also possible to operatively connect with the roller 33 a suitable drive means for driving the roller 33 at a predetermined speed of rotation. Thus, as is schematically shown in FIG. 2A, a D.C. motor 51 the speed of which can be adjusted is, by way of example, a suitable source for driving the roller 33. This motor 51 through suitable belts or chains 52 and 53, which cooperate with suitable pulleys or sprockets, for example, transmits a drive to the smoothing roller 33. This drive will of course rotate the roller 33 in the manner indicated in FIG. 2A and described above at a speed substantially less than the angular speed of the roll 16 which, as was indicated above, may be a roller of the calender shown in FIG. 1 or a roll at another part of the paper machine as described below.

In connection with certain webs 20 of sheet material and in order to achieve certain desirable characteristics in the surface of the finished web, it is advantageous to connect with the support means 30 a reciprocating means for reciprocating the support means together with the smoothing means 32 or 33. In FIG. 2A, set screws are not used to fix the angular position of the beam 30 with respect to the arms 24. Instead the beam 30 is free to reciprocate about the common axis of the pins 31. Thus, FIG. 2A indicates by the arrow A how the beam 30 is angularly reciprocated about the axis formed by the pins 31. The reciprocating means takes the form of a hydraulic unit 23 operatively connected with the beam 30 in the manner shown schematically in FIG. 2A. The fluid under pressure is delivered to the unit 23 in such a way that the beam 30 is angularly reciprocated through a relatively small angle around the axis of the pins 31, and the pressure unit 19 acts to maintain the roller 33 in engagement with the web 20 during reciprocation of the roller 33 together with the support means 30. The motor 51 may be mounted on a bracket which in turn is fixed directly to the beam 30 so that the motor 51 is stationary with respect to the beam 30, and by way of a suitable electrical cord or the like the motor 51 may be connected to a source of electricity.

While reciprocating motion as described above and shown in FIG. 2A is favorable in certain cases when using a roller 33, this reciprocating motion is particularly favorable when using a smoothing means 32 in the form of an elongated shoe which is fixed directly to the beam 30. When using such a smoothing shoe, it is possible as a result of the reciprocation to utilize substantially the entire outer surface of the smoothing shoe providing a substantially uniform wear on the latter, and in addition the temperature of the smoothing shoe 32 cannot rise at any localized area by an excessive amount. In order to contribute to the uniform wear and prevention of an excessive rise in temperature of the shoe 32, while at the same time maintaining the latter during reciprocation in substantially the same line of contact with the web, the elongated smoothing member 32 is convexly curved at its wall or surface which engages the web, and the radius of curvature has its center in the common axis of the pins 31, as shown by the radius R for the smoothing means 32 which engages the calender roll 12 in FIG. 1.

Figure 5:
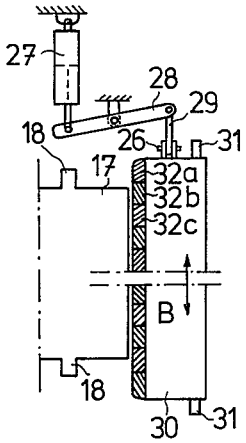
FIG. 5 fragmentarily and schematically illustrates how it is possible to construct the smoothing member or means of the invention from a plurality of components which are assembled together as well as how it is possible to reciprocate the smoothing means longitudinally, as contrasted with the angular reciprocation shown schematically in FIG. 2A.

Although the above-described reciprocating means 23 is operatively connected with the beam 30 to provide for angular reciprocation about the common axis of the pins 31, it is also possible to provide reciprocation along the common axis of the pins 31, so as to achieve in this way a longitudinal reciprocation transversely with respect to the direction of movement of the web 20. Such an arrangement is illustrated in FIG. 5 in a schematic manner. With this arrangement either the smoothing means 32 or the smoothing means 33 may be axially oscillated. Thus, as may be seen from FIG. 5, the beam 30 is connected at one end by a pivot 26 to a link 29 which is pivoted at its end distant from the pivot 26 to a lever 28 supported for swinging movement intermediate its ends at any suitable part of the machine frame or the like. The end of the arm or lever 28 distant from the link 29 is pivotally connected with a piston of a hydraulic unit 27 which in the same way as the unit 23 is actuated in order to angularly reciprocate the lever 28 about its intermediate pivot so as to transmit this reciprocating motion through the link and the pivot 26 to the beam 30 with the result that the support means together with this moving means are axially oscillated. Thus, through this arrangement reciprocating motion in the direction indicated by the arrow B in FIG. 5 is achieved. For this purpose the pins 31 may be made somewhat longer so that they will remain in the openings of the arms 24 during reciprocating motion of the beam 30 together with the smoothing means 32 or 33. In the case of FIG. 5 the arms 24 may be extended below the pins 31 through a distance sufficient to enable these arms to carry a supporting structure on which the beam 30 rests and by which the beam 30 is guided for reciprocating motion in the direction indicated by the arrow B. In addition, the link 29 is pivotally connected to the lever 28 in such a way that the link 29 may be used to prevent swinging of the support 30 about the axis of the pins 31 while the beam 30 moves back and forth along this axis.

In FIG. 5 the smoothing means is shown cooperating with a roll 17 which may be a roll of the machine calender, or a roll or cylinder of the driving section, or a roll of the press section of the machine. The roll 17 is provided with journal pins 18 so that the roll 17 can be supported in suitable bearings.

In accordance with a further feature of the invention, in order to be able to provide an elongated continuous moving member 32 or 33 which extends over and even slightly beyond the entire width of the paper machine or the web which is to be manufactured therewith, it is advantageous to make the smoothing means 32 or 33 of an assembly of elements situated one next to the other along the smoothing means. Thus FIG. 5 schematically illustrates a series of elements **32*a*, 32*b*, 32*c*, etc. These elements are made of the hard material referred to above and have the configuration either of the smoothing shoe 32 or a roller 33. Thus in the case of the roller the elements will take the form of a series of rings which are situated one to the next coaxially with each other and end plates may engage the end rings and be pulled together through a suitable rod to maintain the entire structure in an assembled condition while permitting the entire structure to have the desired length. In the case of smoothing shoes 32, these elements 32*a*, 32*b*, 32*c*, etc. will have the substantially U-shaped curvature apparent from FIG. 1 and will have their free ends situated in suitable grooves or the like formed in the beam 30, with these elements being pressed against each other in any suitable way such as by situating one end element against a suitable stop and providing a threaded member for pressing against the other end element, such a threaded member being carried by a part of the beam 30**.

Figure 3:
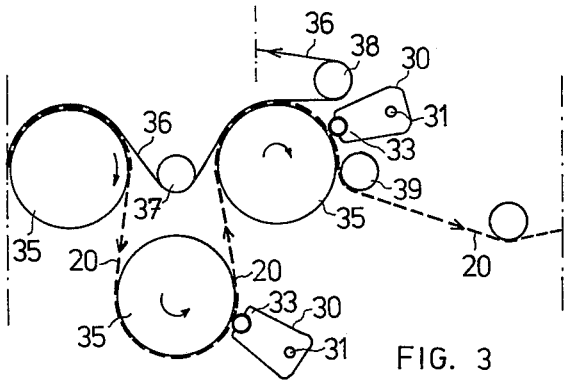
FIG. 3 illustrates how the method and apparatus of the invention can be incorporated into the drying section of a paper machine.

FIG. 3 illustrates the manner in which the method and apparatus of the invention may be incorporated into the drying section of the paper machine. This drying section includes a series of drying rolls or cylinders 35 arranged in part in the manner illustrated in FIG. 3. Thus, such a conventional drying section will have upper and lower rows of drying cylinders or rolls 35, with the rolls 35 of one row being staggered with respect to those of the other row, as indicated in FIG. 3. The web 20 travels along part of its path of movement between the surfaces of the heated drying rolls 35 and a drying felt 36 in a manner which is in itself known in the art. The drying felt 36 is guided by rollers 37 and 38 as illustrated schematically in FIG. 3. The web 20, after leaving the last drying cylinder or roll 35 is guided by rollers 39. In the example illustrated in FIG. 3 is a pair of smoothing rollers 33 form the smoothing means, these rollers being shown as carried by the support means 30 which is supported in the manner described above in connection with FIG. 1, for example. It will be noted from FIG. 3 that the pair of smoothing means 33 are arranged to press against the web 20 as it travels around the last two drying rolls or cylinders 35, the web 20 being lapped around these rolls 35 in the manner shown schematically in FIG. 3. However, one or more smoothing means of the invention may, if desired, be positioned so as to extend along any one or more of the drying cylinders or rolls 35, to coact with the web 20 in the manner shown for the last two cylinders 35 in FIG. 3, and more than two smoothing means may be provided at a corresponding number of drying cylinders or only one smoothing means may be utilized in connection with only one of the drying cylinders.

It is to be noted that the higher the moisture content of the web 20, the easier it is to influence the smoothness of the surface thereof. On the other hand, if the web is still wet to an undesirable degree, or in other words contains an undesirably large amount of moisture, then only a relatively small amount of friction can be provided in connection with such a relatively wet web. Thus, where a relatively wet web is to be engaged by the smoothing means of the invention, it is preferred to use a rotating smoothing roller 33 such as that shown in FIG. 2, such a roller being driven by an independent drive means.

It is to be noted in connection with FIG. 3 that the pair of smoothing means 33 act on the web 20 first on one side and then on the other side thereof, so that the smoothing action is achieved at both sides of the web 20.

Figure 4:
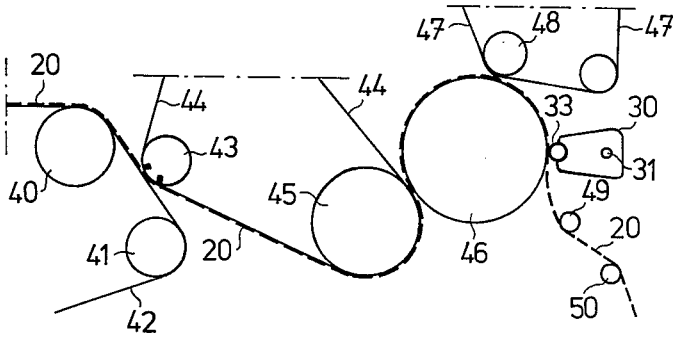
FIG. 4 illustrates how it is possible to incorporate the method and apparatus of the invention into the press section of a paper machine, in particular at the output end of the press section.

FIG. 4 schematically illustrates an arrangement of the invention according to which the smoothing means is incorporated into the press section of the paper machine, and particularly at the output end of the press section. As may be seen in FIG. 4, the web 20 is picked up from the wire 42 on which the web 20 is initially formed in a known manner. The endless wire 42 is guided by a number of rolls which include the rolls 40 and 41 shown in FIG. 4. The web 20 is transferred from the wire 42 to a transfer wire 44 which picks up the web 20 by way of the suction acting at the pick-up roll 43. The web 20 will, after being picked up by the roll 43, travel together with the endless felt or wire 44. In this way the web 20 is guided through a nip defined by a pair of press rolls 45 and 46. At the press roll 46, the web is separated from the felt 44 and continues, while being lapped around the roll 46, to pass through the second nip defined between the rolls 46 and 48, a further drying felt 47 being guided around the roll 48 and additional rolls. At this region, after passing through the nip between the rolls 46 and 48 the web 20 is acted upon by a smoothing means 33 as shown at the right portion of FIG. 4, this smoothing means in the illustrated example being in the form of a roller carried by the support means 30 which is acted upon by the pressure structure described above so as to maintain a desired pressure between the roller 33 and the web, with this roller 33 being driven by a drive means such as the drive means 51–53 described above in connection with FIG. 2A. It is to be noted that at this particular stage, namely at the output end of the press section, the web 20 is still comparatively wet so that it is preferred to utilize at this stage a roller 33 as a smoothing means with the roller 33 being driven because of the relatively small degree of friction which is available at the comparatively wet web 20. As the web travels beyond the smoothing means 33 it is guided by rollers 49 and 50 as shown schematically in FIG. 4.

The most advantageous location for the smoothing means, particularly when it is installed in the drying section as shown in FIG. 3, is a location where the smoothing means will act on that surface of the web which is to form the product such as paper or cardboard which has the most pronounced wire or felt marking.

Of course, an arrangement as shown in FIG. 4 may be combined with that shown in FIG. 3, and in addition these arrangements may be further combined with that shown in FIG. 1, so that the smoothing method and apparatus of the invention can be provided not only at one particular section of the machine but also at a plurality of sections thereof.

Furthermore, it is apparent that with the embodiments of FIGS. 3 and 4 it is possible to utilize a reciprocating means as shown either in FIG. 2A or in FIG. 5, so that in this way the beam 30 and the smoothing means 32 or 33 can be reciprocated as described above. Of course it is to be understood that structures have been illustrated in FIGS. 2A and 5 in particular in a highly schematic manner. The actual structure may differ greatly from the arrangements shown.

As may be seen from FIG. 4, as the web 20 travels beyond the wire 42 it will have a wire side which previously was directly in engagement with the wire 42 while the web will have an opposed top side which did not directly engage the wire. Under these conditions where a pair of smoothing means are used to act on the web, for example in a manner shown in FIG. 3, the microstructure of the smoothing means 32 and 33 which engages the top side of the web, opposite from the side which directly engage the wire, is finer than the microstructure of the smoothing means 32 or 33 which engages the wire side of the web.

The smoothing and burnishing effect of the ceramic or other material used according to the invention in the smoothing members is in part at least based upon the fine porosity of these materials used for the smoothing means. It is of advantage in many instances if the smoothing members 32 or 33 which first engage the web as it travels through the machine and which treat portions of the web which still have a relatively high moisture content to have larger pores than those smoothing members 32 or 33 which are situated subsequent to the first smoothing means and which engage the web when the moisture content thereof has been substantially reduced so as to be less than the moisture content of the web at the portions thereof engaged by the first smoothing means 32 or 33. Thus, the ceramic or other material of the smoothing means of the invention will have a finer porous structure, or in other words smaller pores, at those locations where the smoothness of the paper surface is already relatively high. In the manufacture of different types of paper and cardboard the porosity of the particular smoothing member is selected in accordance with the particular type of paper and the quality thereof.

Moreover, the number and locations of the plurality of smoothing means or shoes can be varied so as to obtain in each case precisely the desired characteristics at the surface of the paper or cardboard, and the achievement of the desired surface characteristics can be further influenced by adjusting the contact pressure between the web 20 and the smoothing means 32 or 33 and by selection of a desired differential velocity ($v_2 - v_1$) between the web 20 and the surface of the smoothing means 32 or 33.

Thus, it is apparent that when utilizing the method and apparatus of the invention in various different types of operations several variables are at the disposal of the operator, so that these variables can be adjusted in order to influence in a desired manner the smoothness and gloss of the paper or cardboard which is produced.

What is claimed is:

1. In a method for operating a machine which manufactures a sheet material such as paper or cardboard, the steps of lapping a moving web of sheet material over a roll of the machine so that the web of sheet material has an inner surface region engaging said roll and an outer surface region directed away from said roll, and pressing against said outer surface region of the sheet material a relatively smooth, hard surface which extends across the entire width of the web of sheet material and forms part of a smoothing member for imparting desired characteristics to the surface of the web engaged by the smoothing member, while maintaining a predetermined pressure between the smoothing member and the web and while providing a frictonal rubbing action between the outer surface region of the web of sheet material and the smoothing member, and including the step of angularly reciprocating the smoothing member about an axis parallel to the axis of said roll while maintaining smoothing member in engagement with said outer surface region of the web of sheet material across the entire width thereof.

2. In a method as recited in claim 1 and wherein said roll forms part of a drying section of the machine.

3. In a method as recited in claim 1 and wherein said roll forms part of a press section of the machine.

4. In a method as recited in claim 1 and wherein said roll forms part of a calender of the machine.

5. In a method as recited in claim 1, and wherein said smoothing member is made at least at said relatively smooth, hard surface thereof of a ceramic substance.

6. In a method for operating a machine which manufactures a sheet material such as paper or cardboard, the steps of lapping a moving web of sheet material over a roll of the machine so that the web of sheet material has an inner surface region engaging said roll and an outer surface region directed away from said roll, and pressing against said outer surface region of the sheet material across the entire width thereof a relatively smooth, hard surface which forms part of a smoothing member for imparting desired characteristics to the surface of the web engaged by said smoothing member, while maintaining a predetermined pressure between the smoothing member and the web and while providing a frictional rubbing action between the outer surface region of the web of sheet material and the smoothing member, rotating said smoothing member with respect to said outer surface region of the web of sheet material while pressing against the latter and while rotating said smoothing member at a speed smaller than the angular speed of the web of sheet material with respect to the axis of said roll, and including the steps of rotating said smoothing member by frictional engagement with said web of sheet material as the latter is guided around said roll and simultaneously braking said smoothing member to retard the rotation thereof for achieving the speed of rotation of said smoothing member which is less than the speed of said web of sheet material.

7. In a method for operating a machine which manufactures a sheet material such as paper or cardboard, the steps of lapping a moving web of sheet material over a roll of the machine so that the web of sheet material has an inner surface region engaging said roll and an outer surface region directed away from said roll, and pressing against said outer surface region of the sheet material across the entire width thereof a relatively smooth, hard surface which forms part of a smoothing member for imparting desired characteristics to the surface of the web engaged by said smoothing member, while maintaining a predetermined pressure between the smoothing member and the web and while providing a frictional rubbing action between the outer surface region of the web of sheet material and the smoothing member, the machine including a pair of said rolls lapped by the web of sheet material with the latter engaging one of said rolls before the other and having a greater moisture content when engaging said one roll as compared with the moisture content when engaging said other roll and pressing against surface regions of the sheet material directed away from both of said rolls a pair of said smoothing members for imparting desired characteristics to the web of sheet material, with the smoothing member which presses against the sheet material at said one roll having pores which are larger than the pores of the smoothing member which presses against the sheet material engaging the other of said rolls.

8. In a machine for manufacturing a paper product such as paper or cardboard, with the machine having a plurality of sections which include a press section, a drying section, and a calendering section, wherein each of said sections includes at least one roll around part of which a web of sheet material which is to form the product is lapped while travelling through said section with said web of sheet material having an inner surface region engaging said one roll and an outer surface region directed away from said one roll, smoothing means situated next to said one roll of at least one of said sections and extending across the entire width of the web of sheet material and engaging and pressing against said outer surface region of the web of sheet material for providing a frictional rubbing action at said outer surface region of said web of sheet material across the entire width thereof to provide at least one surface of the finished product with a desired characteristic, and support means carrying said smoothing means for supporting the latter and maintaining said smoothing means pressed against said outer surface region of the web, a reciprocating means being operatively connected to said smoothing means for angularly reciprocating said smoothing means about an axis parallel to the axis of said one roll so that the surface of said smoothing means which engages the web of sheet material reciprocates angularly with respect to the latter.

9. The combination of claim 8 and wherein said support means has a turning axis parallel to the axis of said one roll, and said smoothing means having for engagement with said outer surface region of said web of sheet material an exterior convexly curved surface whose radius of curvature has its center in the turning axis of said support means.

10. The combination of claim 8 and wherein said smoothing means is in the form of an elongated assembly of components which are assembled one next to the other longitudinally along said smoothing means.

11. The combination of claim 8 and wherein the section which includes said one roll is a drying section of the machine, and said drying section having a pair of drying rolls one of which forms said one roll, and a pair of said smoothing means being respectively situated next to said pair of drying rolls while a pair of support means respectively carries said pair of smoothing means with the latter respectively engaging outer surface regions of the web of sheet material as the latter travels along the drying rolls while being lapped partly around the latter.

12. The combination of claim 11 and wherein the pair of smoothing means are in the form of rotary smoothing rolls supported for rotation by said pair of support means.

13. The combination of claim 8 and wherein said one roll forms part of a press section of the machine and is situated at an output end of the press section.

14. The combination of claim 13 and wherein said smoothing means is in the form of a rotary smoothing roll supported for rotary movement by said support means.

15. The combination of claim 8 and wherein said smoothing means is made of a ceramic substance.

16. In a machine for manufacturing a paper product such as paper or cardboard, with the machine having a plurality of sections which include a press section, a drying section, and a calendering section, wherein each of said sections includes at least one roll around part of which a web of sheet material which is to form the product is lapped while travelling through said section with said web of sheet material having an inner surface region engaging said one roll and an outer surface region directed away from said one roll, smoothing means situated next to said one roll of at least one of said sections for engaging and pressing against said outer surface region of the web of sheet material and for providing a frictional rubbing action at said outer surface region of said web of sheet material across the entire width thereof for providing at least one surface of the finished product with a desired characteristic and support means carrying said smoothing means for supporting the latter and maintaining said smoothing means pressed against said outer surface region of the web, the machine including in advance of said plurality of sections thereof a wire on which the web is initially formed so that the web has a wire side and an opposed side opposite from said wire side, and the machine including a pair of said rolls one of which is engaged by said wire side and the other of which is engaged by said opposed side of the web, a pair of said smoothing means respectively situated next to said pair of said rolls for engaging surface regions of said web respectively directed away from said rolls, and a pair of support means respectively supporting said pair of smoothing means, so that one of said smoothing means engages the wire side and the other of said smoothing means engages the opposed side of the web, and said smoothing means which engages said opposed side of said web having a finer microstructure than the smoothing means which engages said wire side of the web.

17. In a machine for manufacturing a paper product such as paper or cardboard, with the machine having a plurality of sections which include a press section, a drying section, and a calendering section, wherein each of said sections includes at least one roll around part of which a web of sheet material which is to form the product is lapped while travelling through said section with said web of sheet material having an inner surface region engaging said one roll and an outer surface region directed away from said one roll, smoothing means situated next to said one roll of at least one of said sections for engaging and pressing against said outer surface region of the web of sheet material and for providing a frictional rubbing action at said outer surface region of said web of sheet material across the entire width thereof for providing at least one surface of the finished product with a desired characteristic, and support means carrying said smoothing means for supporting the latter and maintaining said smoothing means pressed against said outer surface region of the web, said smoothing means being in the form of a rotary smoothing roller while said support means supports said smoothing roller for rotary movement in response to frictional engagement with the web of sheet material, and brake means engaging said smoothing roller for retarding the rotation thereof to achieve a frictional rubbing between the smoothing roller and the web of sheet material.

18. In a machine for manufacturing a paper product such as paper or cardboard, with the machine having a plurality of sections which include a press section, a drying section, and a calendering section, wherein each of said sections includes at least one roll around part of which a web of sheet material which is to form the product is lapped while travelling through said section with said web of sheet material having an inner surface region engaging said one roll and outer surface region directed away from said one roll, smoothing means situated next to said one roll of at least one of said sections and extending across the entire width of the web of sheet material and engaging and pressing against said outer surface region of the web of sheet material for providing a frictional rubbing action at said outer surface region of said web of sheet material across the entire width thereof to provide at least one surface of the finished product with a desired characteristic, and support means carrying said smoothing means for supporting the latter and maintaining said smoothing means pressed against said outer surface region of the web, said smoothing means including an elongated assembly of components which are assembled one next to the other longitudinally along said smoothing means, and said components being made of a ceramic substance selected from the group consisting of silicium carbide and aluminium oxide.

* * * * *